US010410452B2

(12) United States Patent
Stray et al.

(10) Patent No.: US 10,410,452 B2
(45) Date of Patent: Sep. 10, 2019

(54) BATTERY MODULE HOUSING AND PACKAGING

(71) Applicant: Gentex Corporation, Zeeland, MI (US)

(72) Inventors: Joel A. Stray, Hudsonville, MI (US); Dennis E. Vilcans, West Olive, MI (US); Sinisa Likic, Hudsonville, MI (US); Derek S. Blaskowski, Hudsonville, MI (US); Thomas S. Wright, Holland, MI (US); Jonathan M. Hansen, Zeeland, MI (US); James S. Sheline, Grand Rapids, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 15/962,484

(22) Filed: Apr. 25, 2018

(65) Prior Publication Data

US 2018/0336750 A1 Nov. 22, 2018

Related U.S. Application Data

(60) Provisional application No. 62/506,658, filed on May 16, 2017.

(51) Int. Cl.
*G08B 25/00* (2006.01)
*G07C 9/00* (2006.01)
(Continued)

(52) U.S. Cl.
CPC ..... *G07C 9/00857* (2013.01); *E05F 15/77* (2015.01); *G07C 9/00182* (2013.01);
(Continued)

(58) Field of Classification Search
CPC . G11B 25/043; G11B 33/027; G11B 33/1466; G11B 33/1446; G11B 33/148;
(Continued)

(56) References Cited

U.S. PATENT DOCUMENTS 5,708,415 A 1/1998 Van Lente et al.
5,854,593 A 12/1998 Dykema et al.
(Continued)

FOREIGN PATENT DOCUMENTS

GB 2536465 A 9/2016
RU 26176 11/2002

OTHER PUBLICATIONS

Search Report and Written Opinion of the International Searching Authority, International Application No. PCT/US2018/029311, dated Aug. 2, 2018 (9 pages).

*Primary Examiner* — Daniel Previl
(74) *Attorney, Agent, or Firm* — Price Heneveld LLP; Bradley D. Johnson

(57) ABSTRACT

A circuit assembly comprising a sealed interface is configured to isolate one or more electrical components. The assembly comprises a circuit board comprising a substrate and a cover comprising a polycarbonate material in connection with the substrate. The assembly further comprises an adhesive seal disposed around a perimeter surface of the cover. The adhesive seal comprises a UV curable adhesive having a chemical composition. The assembly further comprises a polyamide over-molded coating enclosing at least a portion of the circuit board and covering the adhesive seal.

17 Claims, 4 Drawing Sheets

(51) Int. Cl.
*G08C 19/28* (2006.01)
*E05F 15/77* (2015.01)
*G08C 17/02* (2006.01)

(52) U.S. Cl.
CPC ..... *G08C 17/02* (2013.01); *G08C 19/28* (2013.01); *E05Y 2800/428* (2013.01); *E05Y 2900/106* (2013.01); *G07C 9/00944* (2013.01); *G07C 2009/00968* (2013.01); *G08C 2201/50* (2013.01); *G08C 2201/62* (2013.01)

(58) Field of Classification Search
CPC . G11B 33/1486; G11B 25/04; H01L 21/2007; H01L 21/304; H01L 51/5246; H01L 51/5237; H01L 2251/5315; H01L 27/323; H01L 51/5259; H01L 21/67092; H01L 21/67144; H01L 21/68778; A61F 13/00068; A61F 13/0216; A61F 13/00063; A61F 2013/00174; A61F 2013/00536; A61F 2013/0054; A61F 13/0206; A61F 13/0213; A61F 13/022; A61F 13/0226; A61F 13/0243; A61F 13/025; A61F 13/0253; A61F 13/0256; A61F 2013/00217; A61F 2013/00246; A61F 2013/00263; A61F 2013/00285; A61F 2013/00646; A61F 2013/00804; A61F 2013/00855; A61F 2013/00902; A61F 13/00029; A61F 13/00046; A61F 13/15739; A61F 13/15747; A61F 13/551; A61F 13/84; A61F 2013/0017; B81B 2201/047; B81B 2203/053; B81B 7/0038; B81B 7/0058; B81C 2203/019; G02B 26/001; G02B 26/0833; G02B 5/3083; G02B 7/006; G02B 26/0841; Y10S 428/917; Y10S 134/901; Y10S 148/908; Y10S 206/813; Y10S 269/903; A45C 11/005; A47G 19/02; A61M 1/0049; A61M 1/0088; A61M 1/0052; A61M 1/0086; A61M 2205/7545; A61M 27/00; A61M 35/00; B65D 51/247; B65D 81/3211; B65D 81/3222; B65D 2585/545; B65D 77/2056; B65D 77/2096; G06F 3/0412; H05K 1/141; H05K 2201/10371; H05K 2201/10378; H05K 3/3436; Y02P 70/613; Y10T 29/4928; Y10T 29/4913; Y10T 29/49144; Y10T 29/49149; Y10T 29/49165; Y10T 428/23; Y10T 428/239; Y10T 428/2852; Y10T 156/1734; Y10T 29/49108; Y10T 29/53978; A61L 12/086; B29C 33/08; B29C 44/569; B29L 2031/58; B65B 7/2864; F16F 2224/0258; G02C 13/008
USPC ..... 340/525, 523, 521, 516, 502, 501, 340/538.12, 538.15, 571, 632, 636.11, 340/643, 309.6, 392.3
See application file for complete search history.

(56) References Cited

U.S. PATENT DOCUMENTS

| | | | | |
|---|---|---|---|---|
| 6,091,343 | A | 7/2000 | Dykema et al. | |
| 2004/0108522 | A1 | 6/2004 | Kahl et al. | |
| 2007/0103833 | A1* | 5/2007 | Harris, IV | H02H 3/027 361/103 |
| 2007/0268581 | A1* | 11/2007 | Palmateer | B81B 7/0038 359/512 |
| 2010/0216020 | A1* | 8/2010 | Ito | H01M 2/0404 429/209 |
| 2013/0206214 | A1* | 8/2013 | Akaike | C08L 23/0815 136/251 |
| 2016/0344444 | A1 | 11/2016 | Yang et al. | |
| 2016/0346977 | A1 | 12/2016 | Drysdale et al. | |
| 2017/0053678 | A1* | 2/2017 | Albrecht | G11B 25/043 |

* cited by examiner

BATTERY MODULE HOUSING AND PACKAGING

CROSS-REFERENCE TO RELATED APPLICATION

This application claims priority to and the benefit under 35 U.S.C. § 119(e) of U.S. Provisional Patent Application No. 62/506,658 filed on May 16, 2017, entitled "BATTERY MODULE HOUSING AND PACKAGING," the entire disclosure of which is hereby incorporated herein by reference.

TECHNOLOGICAL FIELD

The present device generally relates to a circuit assembly and, more particularly, relates to a protective assembly for an electrical device.

SUMMARY OF THE INVENTION

In at least one aspect, a circuit assembly comprising a sealed interface configured to isolate one or more electrical components is disclosed. The assembly comprises a circuit board comprising a substrate and a cover comprising a polycarbonate material in connection with the substrate. The assembly further comprises an adhesive seal disposed around a perimeter surface of the cover. The adhesive seal comprises an ultraviolet (UV) curable adhesive having a chemical composition. The assembly further comprises a polyamide over-molded coating enclosing at least a portion of the circuit board and covering the adhesive seal.

In another aspect, a method for forming a sealed interface for a circuit assembly is disclosed. The method comprises supplying a cover comprising a base portion and applying the cover to a circuit board comprising a substrate thereby forming an interior volume enclosed between the cover and the circuit board. The method further comprises applying a first adhesive portion to the base portion between the cover and the circuit board thereby forming a first adhesive seal. A coating is molded over at least a portion of the circuit board and covers the adhesive seal.

In yet another aspect, a circuit assembly comprising a sealed interface configured to isolate one or more electrical components is disclosed. The assembly comprises a circuit board comprising a substrate and a cover comprising a base portion formed of a polymeric material in connection with the substrate. The cover comprises a groove formed in a perimeter surface. An adhesive seal is disposed in the groove around the perimeter surface of the cover. A polyamide over-molded coating encloses at least a portion of the circuit board and covers the adhesive seal.

These and other features, advantages, and objects of the present device will be further understood and appreciated by those skilled in the art upon studying the following specification, claims, and appended drawings.

DETAILED DESCRIPTION OF EMBODIMENTS

Figure 2B:
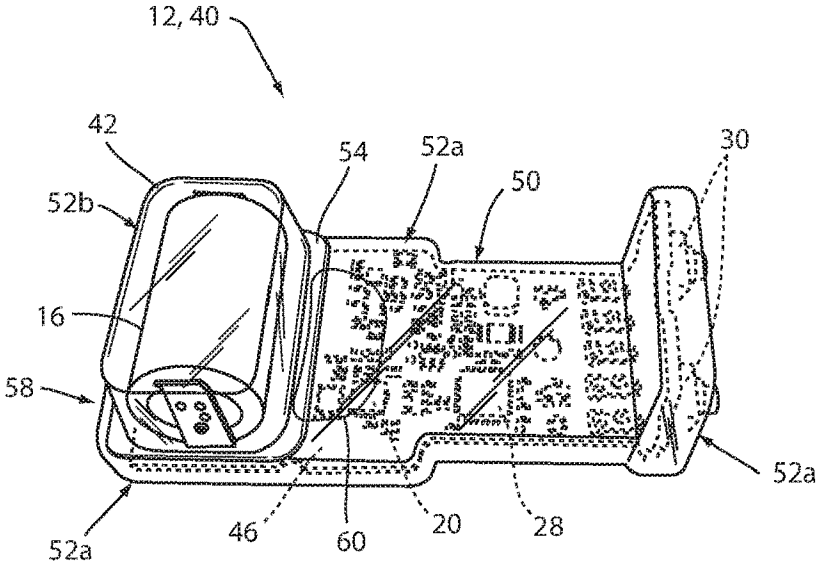
FIG. 2B is a projected view of the circuit assembly of FIG. 2A comprising a molded coating and a cover.
Figure 2A:
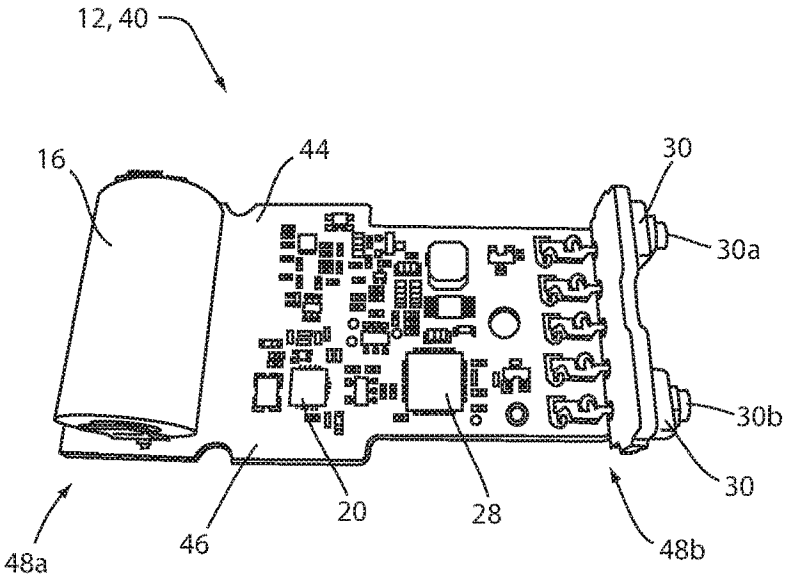
FIG. 2A is a projected view of a circuit assembly.
Figure 3B:
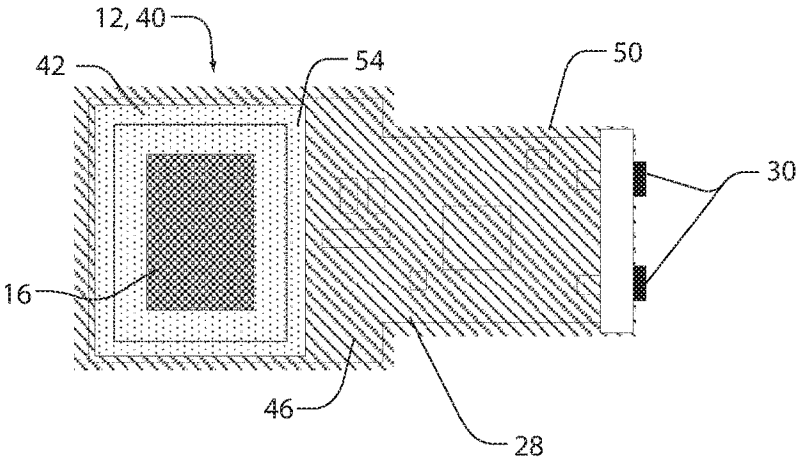
FIGS. 3A, 3B, and 3C are orthographic projected views of a circuit assembly comprising a cover and a molded coating.
Figure 3C:
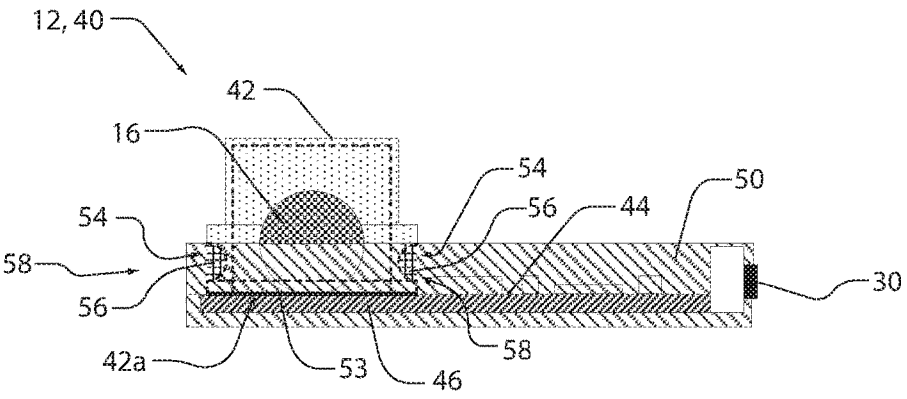
Figure 3A:
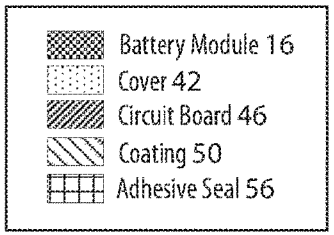
Figure 3A:
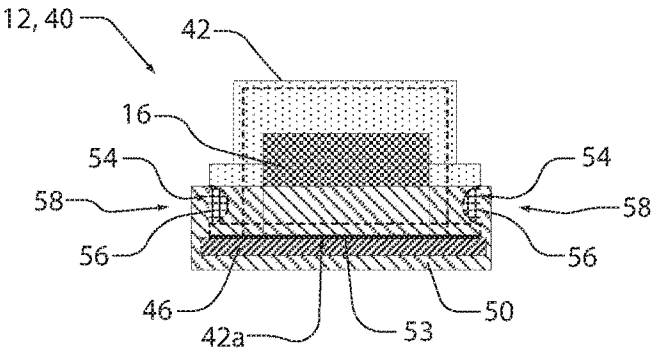

For purposes of description herein the terms "upper," "lower," "right," "left," "rear," "front," "vertical," "horizontal," and derivatives thereof shall relate to the device as oriented in FIGS. 2A and 2B. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The disclosure provides for a battery module and related systems. The battery module may be utilized in a variety of applications and may be particularly suited to applications where the battery module or an associated system is exposed to environmental variations including adverse weather conditions. During the development of the battery module, failures related to various material combinations were identified. The materials and combinations discussed herein may provide for a robust solution for housings or packing for battery modules and may more generally provide for enclosures suited to house electronics or other equipment that may be affected by variations in conditions including, but not limited to, moisture, temperature variation, high humidity" and/or 'humidity-temperature combinations' as a way to capture 85C/85RH, HTHH (high temp, high humidity), salt water, salt fog, World Test, and various other conditions. Further details of test conditions are later discussed in reference to specific performance characteristics of exemplary materials.

In an exemplary embodiment, the battery module may serve as a power supply for a wireless control system. The wireless control system may correspond to a modular electronic device configured for a vehicle. In some embodiments, the wireless control system may be designed to be disposed in a particular portion of the vehicle. For example, the wireless control system may be disposed in a passageway formed by a component of a vehicle (e.g., a handle or grip portion). The various embodiments of the wireless control system discussed herein may provide for remote operation of remotely controlled electronic systems. The remote electronic systems may correspond to various systems configured to control electronic and/or electro-mechanical systems that may correspond to systems utilized in relation to homes, businesses, and various localities having remote electronic systems.

Figure 1:
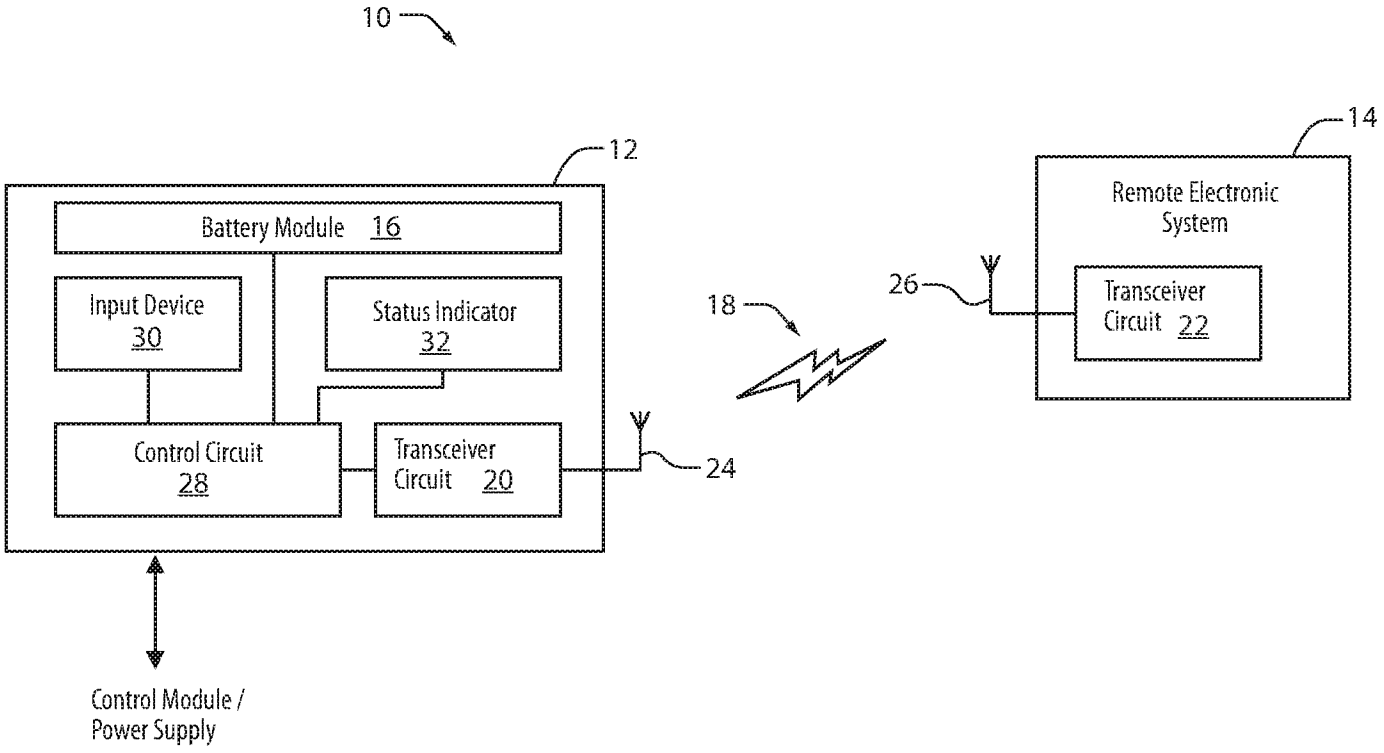
FIG. 1 is a block diagram of a wireless control system in accordance with an exemplary embodiment of the disclosure.

Referring now to FIG. 1, a block diagram 10 of a wireless control system 12 configured to communicate with a remote electronic system 14 is shown. The system 12 may comprise the battery module 16, which may serve as a power supply for the wireless control system 12. Though discussed in reference to the wireless control system 12, the battery module 16 may be utilized in a variety of applications to power a broad range of electrical or electronic devices. Further details regarding the battery module 16 and a related circuit assembly are discussed in reference to FIGS. 2-4.

The wireless control system 12 may comprise a communication interface 18 configured to facilitate the communications with the remote electronic system 14. The remote electronic system 14 may correspond to any of a plurality of remote electronic systems, such as a garage door opener, a security gate control system, security lights, remote lighting fixtures or appliances, a home security system, etc. For example, the remote electronic system 14 may correspond to a garage door opener that may be utilized to access a residential or commercial garage. Accordingly, the communication interface 18 may correspond to a wireless communication interface configured to provide for the wireless control system 12 to wirelessly communicate with the remote electronic system 14.

In some embodiments, the wireless control system 12 may correspond to a stand-alone system configured to operate on power supplied by the battery module 16. The wireless control system 12 may also be in communication with one or more additional systems of the vehicle, for example, a control module and/or a power supply of the vehicle. In such implementations, the control system 12 may further be operable to activate the communication interface 18 to output control signals configured to control the remote electrical system 14 in response to receiving one or more signals from the control module of the vehicle. The one or more signals may correspond to various operating states of the vehicle. For example, the one or more signals may comprise an operating state, may correspond to a drive gear, a drive state (e.g., forward, reverse, or neutral/park), a location of the vehicle identified by a Global Positioning System (GPS) module or alternative positioning module in communication with the control module, an operator identity communicated by the control module, etc. In this way, the control system 12 may be operable to activate different control signals to control various remote electrical systems and/or functions thereof based on the signals received from the control module of the vehicle and any other systems or peripherals in communication with the control module or the control system 12.

The communication interface 18 may be configured to transmit and/or receive signals communicated from the wireless control system 12 to the remote electronic system 14. In an exemplary implementation, the wireless control system 12 may comprise a local transceiver circuit 20 configured to communicate with a remote transceiver circuit 22 of the remote electronic system 14 via wireless signals. The wireless signals may correspond to radio frequency (RF) signals, for example, ultra-high frequency (UHF) band signals, and may also correspond to infrared signals, and/or various other wireless signals. The wireless signals of the local transceiver circuit 20 may be communicated from a local antenna 24 in communication with a remote antenna 26 of the remote transceiver circuit 22.

Each of the transceiver circuits 20 and 22 may transmit and/or receive circuitry configured to communicate signals from the remote antenna 26 to the local antenna 24 and vice versa. For example, the wireless signals may comprise control data configured to cause a garage door opener to open or close a garage door. Additionally, the wireless communication interface 18 may be operable to communicate status signals having status data indicating a status of remote electronic system 14. Such status signals may correspond to a variety of information, such as a success or failure indication of control data sent from the remote transceiver circuit 22. Status signals may further correspond to an indication of whether a garage door is open, closed, or moving between open and closed positions; whether a security system is armed or disarmed; whether a light is on or off; etc.

The wireless control system 12 may comprise a control circuit 28 configured to control various components and/or integrated circuits of the system 12, to store data in memory, operate preprogrammed functionality, send and receive wireless signals, etc. The control circuit 28 may include various types of control circuitry, digital and/or analog, and may include a microprocessor, microcontroller, application-specific integrated circuit (ASIC), or other circuitry configured to perform various input/output, control, analysis, and other functions to be described herein. The control circuit 28 may be coupled to an input device 30, which may include one or more switches (see FIGS. 2 and 3), but may alternatively or additionally include other user input devices, such as switches, knobs, dials, a voice-actuated input control circuit configured to receive voice signals, etc.

The control circuit 28 may further be coupled to a status indicator 32. In various implementations, the status indicator 32 may correspond to one or more light-emitting diodes (LED), a display element, etc. The status indicator 32 may include other or additional display elements, such as a liquid crystal display (LCD). The status indicator 32 may include a single multi-colored LED (e.g., green, red, and yellow) or multiple LEDs, each of which may represent a different color. The status indicator 32 may be configured to display information corresponding to the status of remote electronic system 14 and/or the wireless control system 12. For example, the status indicator 32 may be controlled by the control circuit 28 to emit a first color of light to identify that a signal is sent to the remote electrical system 14 and a second color of light configured to identify when a command requested by the wireless control system 12 is complete.

In operation, the wireless control system 12 may be configured to receive one or more characteristics of an activation signal sent from an original transmitter. An original transmitter is a transmitter, typically a hand-held transmitter sold with the remote electronic system 14. The original transmitter may be configured to transmit an activation signal at a predetermined carrier frequency having control data configured to actuate the remote electronic system 14. For example, the original transmitter may be a hand-held garage door opener transmitter configured to transmit a garage door opener signal at a frequency, such as 355 Megahertz (MHz), wherein the activation signal has control data, which can be a fixed code or a cryptographically-encoded code. The remote electronic system 14 may be configured to open a garage door, for example, in response to receiving the activation signal from the original transmitter.

The transceiver circuit 20 may be configured to receive one or more characteristics of the activation signal from the original transmitter or from another source. The one or more characteristics may include the frequency, control data, modulation scheme, etc. In this configuration, the transceiver circuit 20 or the control circuit 28 may be configured to learn at least one characteristic of the activation signal by receiving the activation signal, determining the frequency of the activation signal, and demodulating the control data from the activation signal. The wireless control system 12 may correspond to a Homelink® trainable transceiver and may be constructed according to one or more embodiments disclosed in U.S. Pat. No. 6,091,343; 5,854,593; or 5,708,415, which are herein incorporated by reference in their entirety.

In some embodiments, the wireless control system 12 may be configured to receive one or more characteristics of the activation signal by other methods. For example, the one or more characteristics of the activation signal may be preprogrammed into a memory of the wireless control system 12 during manufacture or may be input via the input device 30. Accordingly, the wireless control system 12 may be programmed by a variety of methods that may not require receiving the activation signal from an original transmitter in order to identify characteristics of the activation signal. The wireless control system 12 may receive or identify the characteristics of the activation signal by various methods and store the characteristics of the activation signal in memory.

The transceiver circuit 20 may be configured, via the control circuit 28, to generate a carrier frequency at any of a number of frequencies, some of which may correspond to the ultra-high frequency range. The carrier frequency may be approximately between 20 and 470 Megahertz (MHz), and in some implementations may be between 280 and 430 MHz. The control data may be modulated on to the carrier frequency signal via frequency shift key (FSK) or amplitude shift key (ASK) modulation and may utilize additional modulation techniques. The control data on the wireless control signal may be a fixed code, a rolling code, or various cryptographically encoded control codes suitable for use with remote electronic systems.

Referring now to FIGS. 2A, 2B, 3A, 3B, and 3C, a circuit assembly 40 comprising the battery module and a control circuit 28 is shown. For clarity, the circuit assembly 40 will be discussed in reference to the exemplary embodiment of the wireless control system 12. However, it shall be understood that the arrangement of the circuit assembly 40 may be applied to a variety of electronic circuits. As discussed herein, various embodiments of the circuit assembly 40 may comprise the battery module 16. As further discussed herein, the battery module 16 may be enclosed in a sealed assembly comprising a cover 42 or cap configured to engage an interface surface 44 of a circuit board 46 (e.g., printed circuit board [PCB]) of the system 12. In this configuration, cover 42 may isolate the battery module 16 from moisture and contaminants that may be present in the operating environment of the circuit assembly 40.

The circuit assembly 40 may further comprise the control circuit 28 in communication with the battery module 16, the transceiver circuit 20, and the status indicator 32 via a plurality of conductive connections or traces of the circuit board 46. In in this configuration, the circuit assembly 40 may correspond to a stand-alone or add-on device configured to provide self-sustained operation for an extended period based on power supplied from the battery module 16. Additionally, the circuit assembly 40 may be utilized in or from a portable device. Accordingly, the circuit assembly 40 may be configured to suit a variety of applications without departing from the spirit of the disclosure.

The input device 30 may correspond to a user interface. The user interface may comprise a first input 30*a* and a second input 30*b*. As shown, the input device 30 is positioned proximate the distal end portion 48*b* of the circuit assembly 40 opposite a proximal end portion 48*a*, where the battery module 16 is located. The first user input 30*a* and the second user input 30*b* may be accessible by an operator of system 12. In this configuration, the operator may depress the first user input 30*a* and/or the second user input 30*b* to cause the wireless control system 12 to activate and/or program a control signal configured to control the remote electrical system 14. The first user input 30*a* and the second user input 30*b* may correspond to various electrical and/or electro-mechanical switches and may correspond to momentary switches.

In various embodiments, the circuit assembly 40 may be configured to operate in temperatures and environments that may widely vary. Accordingly, the circuit assembly 40 may comprise a plurality of seals and/or surface treatments configured to protect sensitive components required for operation. For example, one or more sealing materials and/or surface treatments may be applied to the cover 42, the battery module 16, and various components in connection with the circuit board 46 or forming part of the circuit assembly 40. In this configuration, the circuit assembly 40 may be configured to preserve robust operation by preventing damage and wear throughout the life of the system 12.

In some embodiments, the circuit assembly 40 may be configured to meet or exceed one or more wear or exposure requirements. For example, in some embodiments, a specification for the circuit assembly 40 may require waterproofing or conformance to a variety of standards (e.g., IP68 waterproof rating). Accordingly, the seals and/or surface treatments applied to the circuit assembly 40 may ensure sustainable performance of the circuit assembly 40 in adverse conditions. In some embodiments, the circuit assembly 40 may comprise an over-molded coating 50 covering a plurality of coated surfaces 52*a* that may otherwise be exposed to the operating environment of the circuit assembly 40. Additionally, in some embodiments, the coating 50 may be omitted from one or more surfaces. The coating 50 may be omitted from one or more of the surfaces such that the surfaces and underlying features remain visible or accessible. In this configuration, the circuit assembly 40 may provide for an over-molded assembly comprising one or more exposed surfaces 52*b* wherein the coating 50 is omitted.

For example, in some embodiments, the cover 42 may be substantially transparent such that the battery module 16 may be visible through the cover 42. In order to preserve the visibility of the battery module 16, through the cover 42, the coating 50 may be omitted from all or part of the cover 42 providing the exposed surface 52*b* and thereby maintaining a viewing region of the battery module 16. In this way, the battery module 16 may be inspected after the coating 50 is applied to the circuit assembly 40. In some embodiments, the cover 42 or cap may be composed of a variety of materials including, but not limited to, Nylon 6, Nylon 44, polyamide, silicone, polyurethane, acrylic, and various other materials. Additional materials that may be utilized for the cover 42 may include clear polycarbonate (Lexan 143-111, Lexan 141-111, Lexan 143R-112, black nylon 6 (Chemlon 253H), clear nylon 12 (Grilamid TR55), and Technomelt PA 6208. Additionally, the coating 50 may be omitted from the buttons or switches of the input device 30.

In some embodiments, the cover 42 may comprise a mounting surface 42*a* configured to engage the interface surface 44 of the circuit board 46. A base seal or first adhesive seal 53 may be disposed between the interface surface 44 and the mounting surface 42*a*. The first adhesive seal 53 may be formed from an adhesive material similar to a second adhesive 56 discussed later. For example, the first adhesive seal 53 may comprise a UV curable acrylic adhesive comprising an at least partial polyamide structure. In some embodiments, the first seal 53 may correspond to one of a variety of adhesive materials including, but not limited to, Dymax 3-20796, Dymax 6-628, Dymax 429G, Dymax 3086T, and other adhesives. In general, the first adhesive seal 53 may provide for a bonded seal between the interface surface 44 of the circuit board 46 and the cover 42 to help ensure that the battery module 16 is isolated from an environment surrounding the circuit assembly 40.

Empirical research of the material utilized to form the first adhesive seal 53 was completed to determine the performance and wear resistance of the material forming the first adhesive seal 53 to seal the interface surface 44 to the cover 42. The research was completed utilizing a number of test conditions to verify the benefits of various exemplary materials for the first adhesive seal 53. Exemplary conditions for defining test definitions for the performance testing are listed as follows:

a. 85/85: 85 degree Centigrade and 85% relative humidity. 1000 hours is a common length of test in the automotive industry.
b. World Test: A harsh thermal cycling test that includes three levels of temperature+ humidity. 48 cycles (4 weeks) is a reasonable length of test.
   i. 85 degree Centigrade, 85% relative humidity (4 hours)
   ii. 65 degree Centigrade, 95% relative humidity (5 hours)
   iii. −40 degree Centigrade (2 hours)
c. Thermal shock: Air-to-air thermal transfer, −40 degree Centigrade to +85 degree Centigrade. One hour dwell at each temperature constitutes a cycle. 1000 cycles is a reasonable test length.

The results of the performance of the first adhesive seal 53 are demonstrated in Table 1.

TABLE 1

Performance results for first adhesive seal 53 under various test conditions

| | Test and Performance | | |
|---|---|---|---|
| Adhesive | 85/85 | World Test | Thermal shock |
| Dymax 429 | Acceptable | Poor | Excellent |
| Dymax 3086T | Poor | Poor | Excellent |
| Dymax 6-628 | Poor | Poor | Excellent |
| Dymax 3-20796 | Excellent | Excellent | Excellent |
| Dymax x-758-33-2 | Excellent | Excellent | Excellent |
| Henkel 3321 | Excellent | Excellent | Excellent |

In an exemplary embodiment, the cover 42 may be formed from a substantially transparent polymeric material. For example, the cover 42 may be formed of a substantially transparent polycarbonate material configured to form an isolated volume housing or enclosing the battery module 16 in connection with the interface surface 44. In this configuration, the cover 42 may extend over the battery module 16 and downward to the interface surface 44 of the circuit board 46. Additionally, the coating 50 may extend to the cover 42 forming a seal interface 54 comprising a second adhesive seal 56. Though described as being in connection with the circuit board 46 and the coating 50, the cover 42 may similarly be bonded or affixed to an intermediate attachment feature or ridge in connection with the circuit board 46. In this way, the attachment feature may be configured to position the cover 42 over the battery module 16 and retain the orientation of the cover 42 relative to the circuit board 46. Though referred to herein as a first adhesive seal 53 and a second adhesive seal 56, the first and second designations are provided for clarity to identify specific elements of the disclosure. Accordingly, such terms shall not be considered limiting to a specific number of elements required to practice any of the beneficial embodiments disclosed.

The coating 50 may correspond to an over-molded material applied to or formed over the circuit assembly 40 in a significantly assembled configuration. In various embodiments, the coating 50 may correspond to a polyamide material applied to the circuit assembly 40 via a low pressure injection molding process. In this way, the coating 50 may provide for a protective coating over the circuit assembly 40. An exemplary material for the coating 50 may correspond to a variety of hot melt over-molded polymers or thermoplastic elastomers (TPEs) including, but not limited to, Technomelt®, Macromelt®, polyamide-acrylic hybrids, co-polymers, silicones, etc. Additional materials that may be utilized for the coating may include polyamides (Technomelt PA 6208, Technomelt PA 641, Technomelt PA 6344, Technomelt PA 7844), copolyesters (Vyloshot TC-955-0R02-B, Vyloshot TC-968-0000-W), and polyesters (Vyloshot GM-960-RK30). In an exemplary embodiment, the coating 50 may comprise a polyamide or polyamide-hybrid structure to promote cohesion with the adhesive seal 56, which may be applied to a seal feature 58 of the cover 42.

In general, the coating 50, when implemented having a polyamide or similar structure, may serve as a protective adhesive coating applied to the plurality of coated surfaces 52*a* of the circuit assembly 40. In this configuration, the coating 50 may serve as a protective adhesive seal. In such embodiments, the adhesion of the coating 50 may be mechanical in effect, relying on the cohesion and structure of the material forming the coating 50 to prevent moisture and/or contaminants from reaching the underlying circuit assembly 40. For this reason, challenges may arise in effectively sealing the cover 42 to the coating 50 along the seal interface 54. Accordingly, the second adhesive seal 56 may correspond to a material sharing a composition comprising at least one material or chemical structure similar to the material of the coating 50. In this configuration, the coating 50 may better adhere to a like or similar material of the second adhesive seal 56 than a substantially different material structure of the cover 42 to provide for an improved seal along the seal interface 54.

For example, the cover 42 may comprise a polycarbonate structure, which may not be particularly favorable for adhering to a polyamide structure of the coating 50. Accordingly, the adhesive material of the second adhesive seal 56 may comprise at least a partial polyamide structure configured to adhere to the polyamide structure of the coating 50. In this way, the adhesion of the second adhesive seal 56 to the coating 50 may improve the resiliency and adhesion of the bond formed by the seal interface 54. The configuration may prevent degradation, particularly in the form of delamination in a delamination region 60 of the coating 50.

In addition to the second adhesive seal 56, in some embodiments, the seal interface 54 may also comprise the seal feature 58. The seal feature 58 may provide for increased surface area for the adhesive material of the second adhesive seal 56 to contact and adhere to the cover 42. Additionally, the seal feature 58 may provide for a mechanical deterrent to resist the delamination of the second adhesive seal 56 and the coating 50. Further discussion of the seal feature 58 and the seal interface 54 in relation to the cover 42 is discussed in reference to FIG. 4.

In some embodiments, the circuit board 46 may be formed of a glass epoxy. For example, the circuit board 46 may correspond to a high-pressure thermoset plastic laminate including, but not limited to, G-10, G-11, FR-4, FR-5 and FR-6. The cover 42 may be formed of a polymeric material, and in some embodiments, may correspond to an at least partially transparent polymeric material to provide for the visibility of the battery module 16 through the cover 42. In an exemplary embodiment, polycarbonate or other similar materials may be utilized for the cover 42 to preserve both structural integrity as well as maintaining the desired transparency. In order to ensure that the seal interface 54 is sufficiently robust to protect the circuit assembly 40, the various combinations of materials and structures of the seal interface 54 may provide for improved performance of the cover 42 and the coating 50 to ensure that the circuit assembly 40 prevails under test conditions, including temperature variations, moisture variations, solvent exposure, and exposure to a variety of chemicals, gasses, and solutions.

During empirical research, the seal interface 54 comprising a variety of material combinations was found to fail testing under various combinations of temperature, liquid, and/or vapor exposure, each of which included a salt-fog test. Each salt-fog test began first with prequalification testing. The prequalification testing included exposing the circuit assembly 40 to freezing temperatures of approximately −40° C. for a period of five hours followed by exposing the circuit assembly 40 to hot temperatures of approximately 85° C. for sixteen hours. Following the prequalification testing, the salt-fog test was completed by exposing the circuit assembly 40 to a vaporized solution of water with 5% sodium chloride (NaCl) at 35° C. for intervals of 24 hours, with a total test duration up to 480 hours.

Following the testing, researchers noted that the parts tested passed the prequalification testing, but failed after the salt-fog testing. The main source of the failure appeared to be caused by delamination of the polyamide material of the coating 50 away from the cover 42 in the delamination region 60. The delamination resulted in a leak in the seal interface 54 and a corresponding failure of the seal interface 54. In some tests, the second adhesive seal 56 was also omitted relying solely on the sealing of the over-molded coating 50 to the cover 42. In additional tests, various adhesive materials were utilized in combination with the coating 50. However, each of the test variants failed at least after the salt-fog test. In addition to the omission of the second adhesive seal 56, a variety of adhesive materials were utilized for the second adhesive seal 56. The materials utilized that failed for the second adhesive seal 56 included various adhesives including UV curable acrylic adhesives, such as Dymax 3-20796, Dymax 6-628, Dymax 429G, Dymax3086T, and other adhesives.

Referring to Table 2, the test results for salt-fog testing of the second adhesive seal 56 are shown.

TABLE 2

Salt-fog test results for exemplary materials of the second adhesive seal 56 to the low pressure molded material of the coating 50

| Adhesive | Salt Fog Test Performance |
|---|---|
| Loctite 3321 | Good |
| Loctite 3321/Dymax 3-20796 | Poor |
| Dymax 3-20796 | Adequate |
| Dymax 3-20796 + 0.5% methacrylsilane | Good |
| Dymax 3-20796 + 0.5% glycidoxysilane | Poor |
| Dymax 429 | Poor |
| Dymax 429 + 5% N,N dimethylacrylamide | Poor |
| Dymax 429 + 0.5% methacrylsilane | Poor |
| Dymax 429 + 0.5% glycidoxysilane | Poor |
| Dymax x-758-33-2 | Excellent |
| Dymax x-758-33-2 + 5% N,N dimethylacrylamide | Poor |
| Dymax X-758-33-2 + 0.5% methacrylsilane | Excellent |

TABLE 2-continued

Salt-fog test results for exemplary materials of the second adhesive seal 56 to the low pressure molded material of the coating 50

| Adhesive | Salt Fog Test Performance |
|---|---|
| Dymax X-758-33-2 + 0.5% glycidoxysilane | Adequate |
| Dymax 429 + 5% N,N dimethylacrylamide + 0.5% glycidoxysilane | Poor |
| Dymax 429 + 10% N,N dimethylacrylamide | Adequate |
| Dymax x-758-33-2 + 5% N,N dimethylacrylamide + 0.5% glycidoxysilane | Poor |
| Dymax x-758-33-2 + 10% N,N dimethylacrylamide | Good |

N,N dimethacrylamide: CAS#: 2680-03-7 (Sigma Aldrich; St. Louis, MO)
Glycidoxysilane: CAS#: 2530-83-8 (Gelest; Morrisville, PA)
Methacrylsilane: CAS#: 2530-85-0 (Gelest; Morrisville, PA)

Though some of the above-noted materials performed poorly under the conditions of the salt-fog test for the second adhesive seal 56 as discussed herein, certain formulations in unaltered form performed well. The addition of additives to formulations that did not perform well in an unaltered state did not enhance or correct the poor performance of the original formulations. Additions of preferred formulations to poor formulations also do not improve in the performance of the formulations in the salt fog performance. In fact, the addition of a silane or monomeric amide to an already "Excellent" formula did not improve the salt fog performance for any of the formulations tested. Additions, in all cases, either saw performance stay the same or regress. In general, the relative composition of the second adhesive seal 56 in relation to the coating 50 was the most significant factor in a successful design. Within a formulation, the proprietary monomers and oligomers that construct the polymeric network may be the factors in whether the second adhesive seal 56 will couple well to the coating 50.

In an exemplary embodiment, the second adhesive seal 56 may correspond to Henkel® 3321, UV curable adhesive. The test results demonstrated that the second adhesive seal 56 of Henkel® 3321 survived the salt-fog test when used in combination with the polyamide material of the coating 50. More specifically, the Henkel® 3321 formula was slightly altered and filled with 2% TS-720 (Cabot Corporation; Alpharetta, Ga.) thereby thickening the adhesive of the second adhesive seal 56. Additionally, the specific material utilized for successful implementation of the seal interface 54 comprised the over-molded coating 50 implemented as Macromelt®, Technomelt® by Henkel®. Accordingly, the combination of the interface of the polycarbonate material of the cover 42 and the FR-4 substrate of the circuit board 46 may provide for a superior bonding combination when adhered with Henkel® 3321 and sealed with Macromelt, Technomelt. At least a portion of the composition of Henkel® 3321 is disclosed in the Safety Data Sheet as follows: 30-40% Isobornyl acrylate (5888-33-5), 10-20% N,N-Dimethylacrylamide (2680-03-7), 1-5% Gamma-glycidoxypropyl trimethoxysilane (2530-83-8), 1-5% Silica, amorphous, fumed, crystal-free (112945-52-5), and 0.1-1% 2-Hydroxyethyl acrylate (818-61-1).

Figure 4:
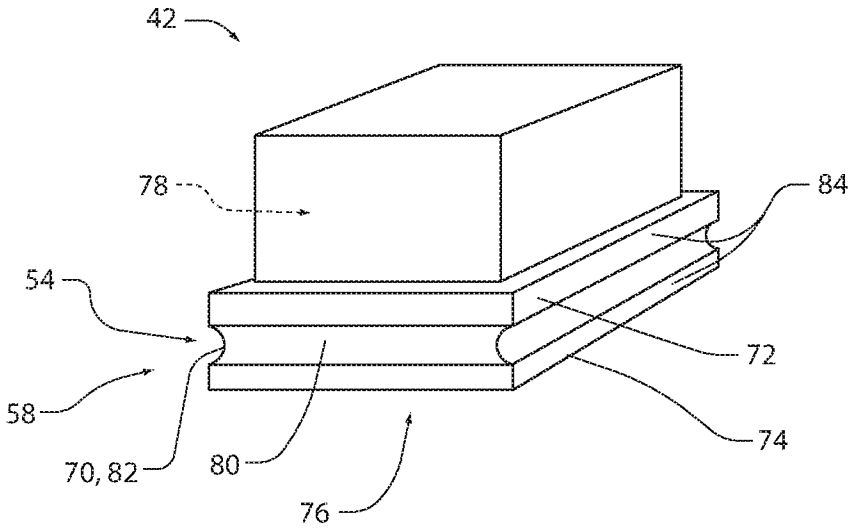
FIG. 4 is an oblique projected view of a cover of a circuit assembly in accordance with the disclosure.

Referring now to FIG. 4, a projected view of the cover 42 is shown further demonstrating the seal feature 58 and the seal interface 54. The seal feature 58 may comprise a lip or contoured groove 70 extending around a perimeter of the cover 42 between a first ridge 72 and a second ridge 74 formed by the cover 42. The first ridge 72 and a second ridge 74 may form a base portion 76 extending from a cavity 78 formed by the cover 42. The first ridge 72 and a second ridge 74 may correspond to a structural support forming the base portion 76, which is further configured to be assembled in mating contact with the circuit board 46. In this configuration, the cover 42 may provide for protective barrier for the battery module 16 to prevent damage and contamination of to the battery module 16 and related sensitive electrical components.

The contoured groove 70 of the seal interface 54 may provide for a bonding surface 80 for the adhesive material of the second adhesive seal 56. In this configuration, the groove 70 may provide for increased surface area between the bonding surface 80 and the second adhesive seal 56. Additionally, the groove 70 may provide for a protected trough 82 configured to receive the adhesive seal 56. In an exemplary embodiment, the adhesive material of the second adhesive seal 56 may be applied or deposited in the groove 70 such that the adhesive substantially fills the groove 70 extending proximate to an outer surface 84 of the ridges 72 and 74. In this configuration, the seal interface 54 may require an increase in penetration of contaminants beginning proximate the first ridge 72 and extending along the bonding surface 80 prior to a breach of the protective layer formed by the cover 42 and the coating 50.

As discussed previously, the cover 42 may comprise a polycarbonate structure, which may not be particularly favorable for adhering to a polyamide structure of the coating 50. Accordingly, the adhesive material of the second adhesive seal 56 may comprise at least a partial polyamide structure configured to adhere to the polyamide structure of the coating 50. In this way, the adhesion of the second adhesive seal 56 to the coating 50 may improve the resiliency and adhesion of the seal interface 54.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, or the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A circuit assembly comprising a sealed interface configured to isolate one or more electrical components, the assembly comprising:
   - a circuit board comprising a substrate;
   - a cover forming a cavity configured to enclose a battery, the cover comprising a polycarbonate material in connection with the substrate about a perimeter of the battery, wherein the cover forms the cavity as an interior volume enclosed between the cover and the substrate;
   - an adhesive seal disposed around a perimeter surface of the cover; and
   - a polyamide over-molded coating enclosing at least a portion of the circuit board and covering the adhesive seal.

2. The circuit assembly according to claim 1, wherein the coating, the adhesive seal, and the cover form the sealed interface enclosing the portion of the circuit board.

3. The circuit assembly according to claim 1, further comprising:
   - a battery module in connection with the circuit board and disposed in the interior volume.

4. The circuit assembly according to claim 1, wherein the cover is formed of an at least partially transparent polymeric material such that the battery module is visible through the cover.

5. The circuit assembly according to claim 1, wherein the substrate comprises a high-pressure thermoset plastic laminate.

6. The circuit assembly according to claim 1, wherein the polyamide over-molded coating comprises Technomelt® or comparable chemical formulas.

7. The circuit assembly according to claim 1, wherein the adhesive seal comprises a UV curable adhesive.

8. The circuit assembly according to claim 7, wherein the UV curable adhesive comprises at least one of a Henkel® 3321 or a Dymax x-758-33-2.

9. A method for forming a sealed interface for a circuit assembly, the method comprising:

supplying a cover comprising a base portion;

applying the cover to a circuit board comprising a substrate thereby forming an interior volume enclosed between the cover and the circuit board;

enclosing a battery within the interior volume;

applying a first adhesive portion to the base portion between the cover and the circuit board thereby forming a first adhesive seal significantly around a perimeter of the battery; and molding a coating over at least a portion of the circuit board and covering the adhesive seal.

10. The method according to claim 9, wherein supplying the cover comprises supplying the cover having a groove formed in the base portion.

11. The method according to claim 10, further comprising:

applying a second adhesive portion into the groove.

12. The method according to claim 11, further comprising:

forming a second adhesive seal between the second adhesive portion in the groove and the coating, wherein the coating is molded over at least the portion of the circuit board, the first adhesive seal, and the second adhesive seal.

13. A circuit assembly comprising a sealed interface configured to isolate one or more electrical components, the assembly comprising:

a circuit board comprising a substrate;

a cover comprising a base portion formed of a polymeric material in connection with the substrate, wherein the cover comprises a groove formed in a perimeter surface, wherein the groove forms a bonding surface configured to adhere to the adhesive seal and the bonding surface of the groove provides for an increased surface area relative to an exterior surface of the cover extending where the groove is formed;

an adhesive seal disposed in the groove around the perimeter surface of the cover; and a polyamide over-molded coating enclosing at least a portion of the circuit board and covering the adhesive seal.

14. The circuit assembly according to claim 13, wherein the coating, the adhesive seal, and the cover form the sealed interface enclosing the portion of the circuit board.

15. The circuit assembly according to claim 13, wherein the groove is formed in the base portion between a first ridge and a second ridge.

16. The circuit assembly according to claim 13, wherein the groove forms a trough supported on two sides by the first ridge and the second ridge.

17. The circuit assembly according to claim 16, wherein at least one of the first ridge and the second ridge extend at least partially between a surrounding environment of the circuit assembly and the adhesive seal.

* * * * *